US011359484B2

(12) United States Patent
Patterson

(10) Patent No.: US 11,359,484 B2
(45) Date of Patent: Jun. 14, 2022

(54) EXPANDABLE FILTRATION MEDIA AND GRAVEL PACK ANALYSIS USING LOW FREQUENCY ACOUSTIC WAVES

(71) Applicant: Douglas J. Patterson, Magnolia, TX (US)

(72) Inventor: Douglas J. Patterson, Magnolia, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/688,296

(22) Filed: Nov. 19, 2019

(65) Prior Publication Data

US 2020/0157935 A1 May 21, 2020

Related U.S. Application Data

(60) Provisional application No. 62/769,830, filed on Nov. 20, 2018.

(51) Int. Cl.
*E21B 47/107* (2012.01)
*E21B 47/14* (2006.01)
(Continued)

(52) U.S. Cl.
CPC ..... *E21B 47/14* (2013.01); *E21B 47/0224* (2020.05); *E21B 47/107* (2020.05); *E21B 17/1078* (2013.01)

(58) Field of Classification Search
CPC combination set(s) only.
See application file for complete search history.

(56) References Cited

U.S. PATENT DOCUMENTS 4,215,427 A * 7/1980 Waggener ..... E21B 47/18 367/83
4,742,496 A * 5/1988 Jennings, Jr. ..... E21B 43/04 166/250.17

(Continued)

FOREIGN PATENT DOCUMENTS

EP 3147449 A1 3/2017

OTHER PUBLICATIONS

Non-Final Office Action for Application No. 16/050.734; dated Jun. 23, 2020; 26 Pages.

(Continued)

*Primary Examiner* — Taras P Bemko
*Assistant Examiner* — Ronald R Runyan
(74) *Attorney, Agent, or Firm* — Cantor Colburn LLP

(57) ABSTRACT

An apparatus for monitoring deployment of filtration media at least partially surrounding a tubular disposed in a borehole penetrating the earth includes a carrier configured to be conveyed through the tubular, a low-frequency acoustic wave source disposed on the carrier and configured to transmit acoustic waves in a frequency that is less than 3000 Hz into the tubular, and an acoustic wave receiver disposed on the carrier a distance from the low-frequency acoustic wave source and configured to receive acoustic waves transmitted by the low-frequency acoustic wave source. The apparatus also includes a controller configured to compare data characterizing the received acoustic waves to reference data characterizing acoustic waves with the filtration media not deployed.

18 Claims, 3 Drawing Sheets

(51) Int. Cl.
*E21B 47/0224* (2012.01)
*E21B 17/10* (2006.01)

(56) References Cited

U.S. PATENT DOCUMENTS 5,477,101 A * 12/1995 Ounadjela ..... G01V 1/145 310/334
8,225,867 B2 7/2012 Hartog et al.
2003/0123326 A1* 7/2003 Wisniewski ..... G01V 1/52 367/140
2004/0060709 A1* 4/2004 Vidrine ..... E21B 23/04 166/380
2005/0205268 A1 9/2005 Engels et al.
2006/0096105 A1 5/2006 Haugland
2007/0235185 A1 10/2007 Patel et al.
2010/0051262 A1 3/2010 Dusterhoft et al.
2011/0011576 A1 1/2011 Cavender et al.
2011/0036565 A1 2/2011 Holderman et al.
2012/0325476 A1* 12/2012 Brenneis ..... C04B 26/02 166/292
2016/0160617 A1 6/2016 Garza et al.
2017/0199295 A1 7/2017 Mandal
2018/0023383 A1 1/2018 Hori et al.
2018/0038979 A1 2/2018 Willis
2019/0383130 A1* 12/2019 Fox ..... G01V 5/107
2020/0040712 A1* 2/2020 Malbrel ..... E21B 47/08

OTHER PUBLICATIONS

International Search Report and the Written Opinion of the International Searching Authority; PCT/US2019/038379 dated Oct. 16, 2019; 8 pages.
International Search Report and the Written Opinion of the International Searching Authority; PCT/US2019/062322 dated Mar. 10, 2020; ISR 6 pages, WO 6 pages, 12 pages total.

* cited by examiner

EXPANDABLE FILTRATION MEDIA AND GRAVEL PACK ANALYSIS USING LOW FREQUENCY ACOUSTIC WAVES

This application claims the benefit of an earlier filing date from U.S. Provisional Application Ser. No. 62/769,830 filed Nov. 20, 2018, the entire disclosure of which is incorporated herein by reference.

BACKGROUND

Hydrocarbons are typically extracted from a subsurface formation via a tubular string having inlet openings disposed in a wellbore to allow the hydrocarbons to enter the string from the formation. Because particulates may be produced from the formation entrained with the target fluid, filtering media may be used to prevent the particulates entering the string. Different types of filtering media include expandable filtration media and gravel packs, for example. However, in order for the filtration media to be effective, it must be deployed correctly. In that the filtration media may be deployed deep in the subsurface environment, it can be challenging to monitor its deployment. Hence, innovations that improve monitoring of the deployment of the filtration media in the wellbore would be well received in the hydrocarbon production industry.

SUMMARY

Disclosed is an apparatus for monitoring deployment of filtration media at least partially surrounding a tubular disposed in a borehole penetrating the earth. The apparatus includes: a carrier configured to be conveyed through the tubular; a low-frequency acoustic wave source disposed on the carrier and configured to transmit acoustic waves in a frequency that is less than 3000 Hz into the tubular; an acoustic wave receiver disposed on the carrier a distance from the low-frequency acoustic wave source and configured to receive acoustic waves transmitted by the low-frequency acoustic wave source; and a controller configured to compare data characterizing the received acoustic waves to reference data characterizing acoustic waves with the filtration media not deployed.

Also disclosed is a method for monitoring deployment of filtration media at least partially surrounding a tubular disposed in a borehole penetrating the earth. The method includes: conveying a carrier through the tubular; transmitting acoustic waves in a frequency that is less than 3000 Hz into the tubular using a low-frequency acoustic wave source disposed on the carrier; receiving the transmitted acoustic waves using an acoustic wave receiver disposed on the carrier a distance from the low-frequency acoustic wave source; and comparing data characterizing the received acoustic waves to reference data characterizing acoustic waves with the filtration media not deployed to monitor the deployment of the filtration media.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and no limitation with reference to the Figures.

Disclosed are apparatuses and methods for monitoring deployment of filtration media at least partially surrounding a tubular member disposed in a borehole penetrating a subsurface formation, The term "monitoring" relates to determining if the deployment was successful or unsuccessful where successful means the deployment occurred as desired for proper operation. The tubular member, which may be referred to a base-pipe in certain embodiments, is a part of a string disposed in a borehole or wellbore and is used to convey hydrocarbons from a downhole location to a surface location. In general, the tubular member has openings that allow hydrocarbons to enter the member from an annulus surrounding the tubular member. An acoustic tool is conveyed through the tubular member to a location having the filtration media. The acoustic tool includes both an acoustic wave source and receiver such that transmitted acoustic waves propagate along the tubular member from the transmitter to the receiver. Due to the presence of hydraulic leakage from inside the tubular member out into the formation through the openings, acoustic waves will leak through the openings and manifest themselves by attenuation of acoustic waves received by the receiver. In particular, low-frequency acoustic casing tube waves in a frequency that is less than 3000 Hz are transmitted into the tubular member using an acoustic wave source on the tool within the tubular member. The transmitted acoustic waves are received by a low-frequency acoustic wave receiver disposed on the tool a certain distance from the acoustic wave source. The frequency response of a system that includes the tubular member and the filtration media will depend on whether the filtration media was successfully deployed or not. In general, the amplitude of one or more peaks of the received acoustic waves will be significantly attenuated when expandable filtration media is successfully deployed. This is because the filtration media when expanded (i.e., successfully deployed) will have a higher permeability than the permeability in the compressed state, thus, enabling increased leakage of acoustic energy through the openings and into the formation wall. With gravel pack filtration media, the opposite will be true because having the gravel pack in place will prevent more acoustic energy from leaking through the openings than without having the gravel pack in place.

Figure 1:
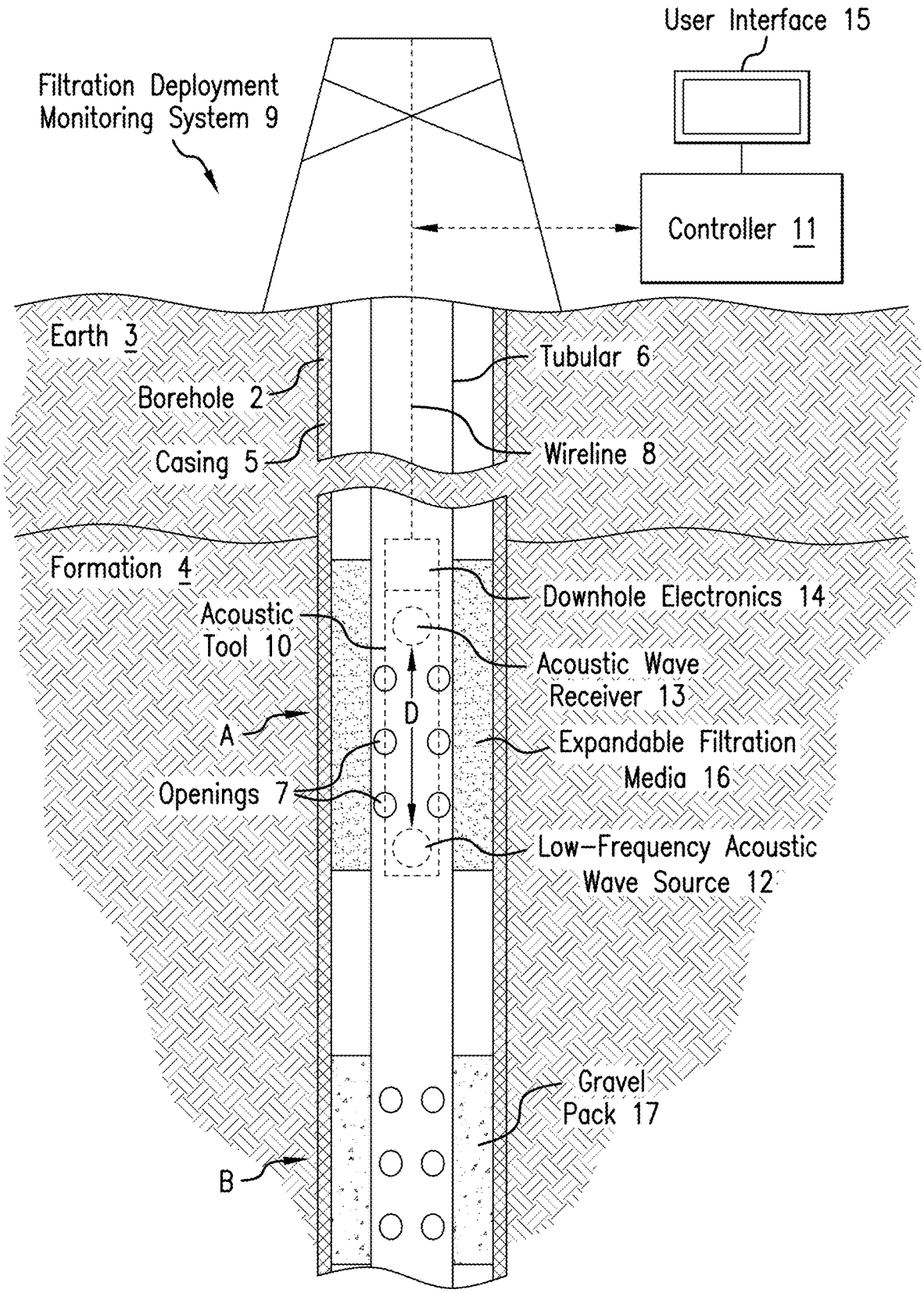
FIG. 1 illustrates a cross-sectional view of a filtration media deployment monitoring system for monitoring the deployment of filtration media in a borehole.

FIG. 1 illustrates a cross-sectional view of a filtration deployment monitoring system 9 for monitoring the deployment of filtration media in a borehole. An acoustic tool 10 is disposed in a tubular member 6 within a borehole 2 penetrating a subsurface area 3. A casing 5 lines the borehole 2, however, the teachings are equally useful in an open borehole. The area 3 includes a formation 4 which can contain a reservoir of hydrocarbons that may be extracted by entering the tubular member 6 via openings 7. The tool 10 is conveyed through the tubular member 6 by a carrier such as a wireline 8, which may provide power and communications capability to the tool 10. The acoustic tool 10 may provide acoustic data to a controller 11 disposed at a surface location and/or may receive commands from the controller 11 for operation of the tool 10. The controller 11 may be coupled to a user interface 15 such as a display or printer for providing deployment information to a user or a keyboard for inputting command information by the user.

The acoustic tool 10 includes a low-frequency acoustic wave source 12 that is configured to emit or transmit acoustic waves in a frequency that is less than 3000 Hertz. In one or more embodiments, the low-frequency acoustic wave source 12 is an electrical transducer configured to convert electrical energy in the form of an electrical signal to acoustic energy in the form of acoustic waves. Non-limiting examples of electrical transducers include permanent magnet types and piezoelectric types. In one or more embodiments, the low-frequency acoustic wave source 12 is a monopole that symmetrically radiates acoustic energy in all or most directions. Other types of acoustic wave source configurations may also be used. While FIG. 1 illustrates one low-frequency acoustic wave source 12, multiple acoustic wave sources 12 may be used such as to create an array of acoustic wave sources 12.

The acoustic tool 10 also includes an acoustic wave receiver 13 that is spaced a distance D from the low-frequency acoustic wave source 12. In one or more embodiments, the acoustic wave receiver 13 may be implemented by an electrical transducer configured to convert acoustic energy in the form of acoustic waves into electrical energy in the form of an electrical signal. In one or more embodiments, the acoustic wave receiver 13 is a monopole receiver that is symmetrically sensitive to acoustic waves from all or most directions. Other types of acoustic wave receivers may also be used. While FIG. 1 illustrates one acoustic wave receiver 13, multiple acoustic wave receivers 13 may be used such as to create an array of acoustic wave sources 13.

The acoustic tool 10 further includes downhole electronics 14. The downhole electronics 14 are configured to operate the tool 10, process acoustic data received by the acoustic wave receiver 13, and/or provide a telemetry interface for communication with the controller 11. Operational and/or processing functions may also be shared with or performed by the controller 11.

At location "A" in FIG. 1, expandable filtration media 16 is illustrated in an expanded state and, thus, being successfully deployed. In the expanded state, the expandable filtration media 16 is expanded to fill an annulus between the tubular member 6 and the casing 5. The filtration media 16 is run downhole in a compressed state generally wrapped around openings in the tubular member 6 and does not completely fill the annulus to the casing 5. The filtration media 16 is then activated either thermally or with an activation fluid to expand toward a pre-compressed state that will completely fill the annulus making contact with the casing 5. A non-limiting embodiment of the expandable filtration media 16 includes a shape memory material such as a shape memory polymer (SMP). In the compressed state, the filtration media 16 is denser and less permeable than when the filtration media 16 is in the expanded state. Consequently, the filtration media in the compressed state is more effective at limiting transmission of acoustic waves through the openings 7 than when the filtration media 16 is in the expanded state. Hence, more acoustic energy will pass through or leak through the openings 7 when the filtration media 16 is in the expanded state than when the filtration media 16 is in the compressed state. Accordingly, the received acoustic waves will be more attenuated when the filtration media 16 is in the expanded state than when the filtration media 16 is in the compressed state due to the increase in acoustic leakage through the openings 7.

In order to monitor deployment of the expandable filtration media 16, data characterizing the received acoustic waves in the expanded state is compared to reference data characterizing received acoustic waves in the compressed or non-expanded state. The data characterizing received acoustic waves in the compressed or non-expanded state can be obtained by transmitting and receiving acoustic waves using the acoustic tool 10 with the expanded filtration media 16 being in the compressed or non-expanded state. The comparison can include identifying and/or quantifying attenuation of amplitude of the received acoustic waves with respect to the reference data. Alternatively or in addition, the comparison can include identifying and/or quantifying any changes in spectral frequency content of the received acoustic waves with respect to the reference data. In a non-limiting embodiment, the changes in the spectral content may include a reduced amplitude in a spectral wave form with respect to a corresponding spectral wave form in the reference data. In order to prevent noise from interfering with the comparison, a threshold value of attenuation can be selected that is above the noise level. In other words, an amount of attenuation that exceeds a threshold value can be indicative of the expandable filtration media 16 being deployed (i.e., expanded) successfully. It can be appreciated that reference data does not have to be obtained for monitoring deployment of each individual expanded filtration media assembly, but can be obtained previously based on acoustic measurements involving the same type or similar expandable filtration media assemblies.

Figure 2:
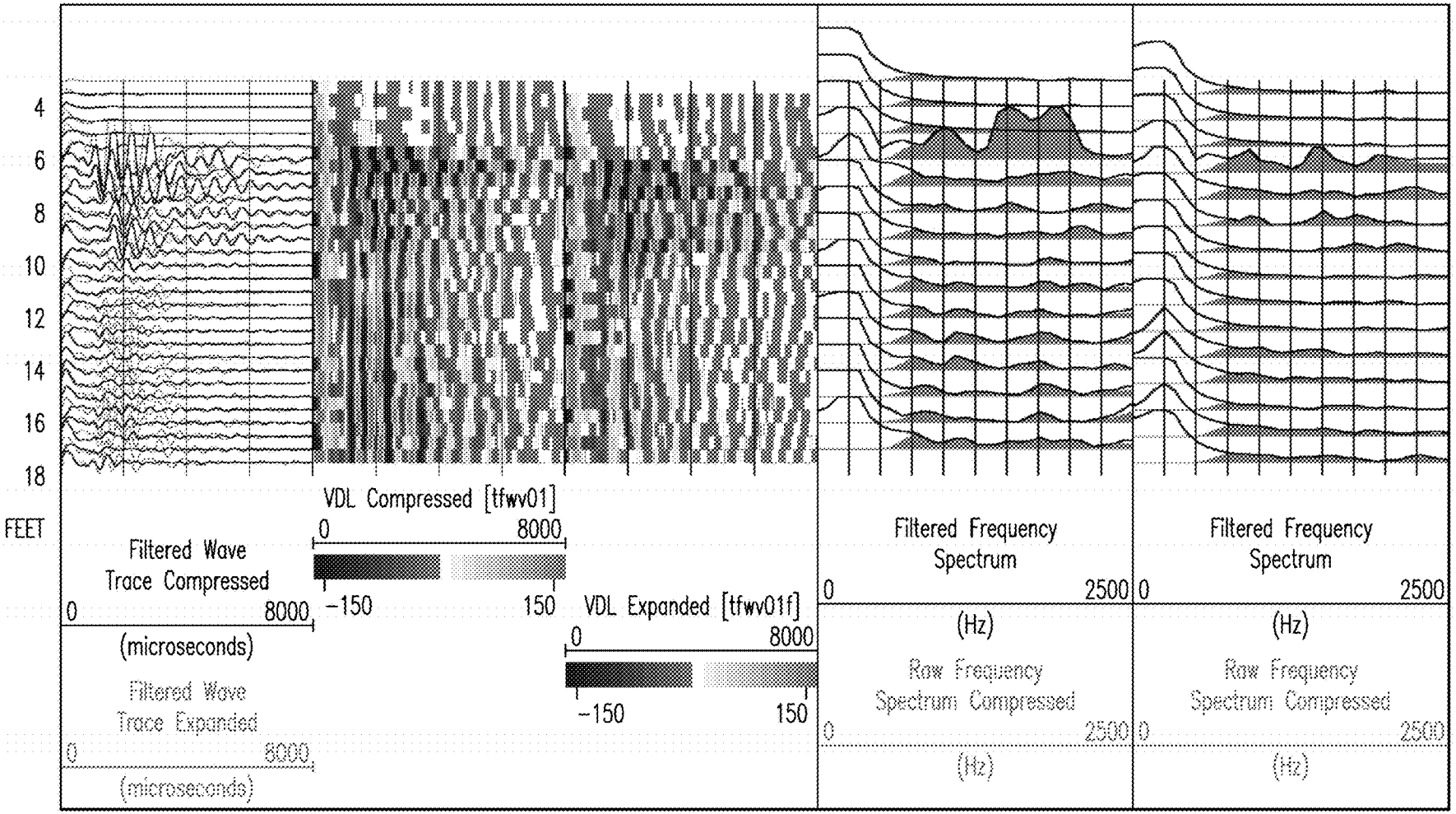
FIG. 2 depicts aspects of data obtained from testing the filtration media deployment system with expandable filtration media.

FIG. 2 illustrates one example of data characterizing receiving acoustic waves when the expandable filtration media 16 is compressed and when the expandable filtration media 16 is expanded. Looking at the right side of FIG. 2, it is readily apparent that there is significant and quantifiable attenuation of the received acoustic waves with the expandable filtration media 16 in the expanded state in comparison to the expandable filtration media 16 in the compressed state. An amount of attenuation can be determined by several methods. In one method, a ratio of an amplitude of one or more peaks in the expanded state data to an amplitude of corresponding one or more peaks in the compressed state data is determined. In another method, the area under a frequency response curve for the expanded state is compared to the area under the corresponding frequency response curve for the compressed state. The attenuation may be quantified as a ratio of the area for the expanded state to the area for the compressed state. Other methods may also be used.

Referring back to FIG. 1, a gravel pack 17 is illustrated at location "B" filling the annulus between the tubular member 6 and the casing 5. The gravel pack 17 uses grains of minerals of a selected size to prevent sand from entering the tubular member 6. Before the gravel pack 17 is deployed or placed downhole to fill the annulus, the annulus may be filled with fluid, which is less dense and more permeable to acoustic waves than the gravel pack 17. Consequently, the deployed gravel pack is more effective at blocking or preventing acoustic waves from leaking from the tubular member 6 than when the gravel pack 17 is not deployed. Hence, monitoring for successful deployment of the gravel pack 17 is the reverse of monitoring for the successful expansion of the expandable filtration media 16. That is, successful deployment of the gravel pack 17 will be indicated by having less attenuation of the received acoustic waves compared to the received acoustic waves when the gravel pack 17 is not deployed. Or in other words, the reference data (gravel pack not deployed) will characterize the received acoustic waves being attenuated in comparison to the received acoustic waves with the gravel pack 17 deployed. As with monitoring deployment of the expandable filtration media 16, a threshold value of attenuation can be selected to prevent noise from interfering with the comparison such that an amount of attenuation of the reference data with respect to the data monitoring deployment that exceeds the threshold value will be indicative of successful deployment of the gravel pack 17. It can be appreciated that the filtration deployment monitoring system 9 may also be used to detect a packed-off gravel pack condition. This condition develops when fines from the formation enter the voids between gravel stones in the gravel pack to reduce the permeability of the gravel pack 17 significantly further than the permeability without the fines. To detect the packed-off gravel pack, acoustic waves or acoustic wave data obtained from a normal gravel pack placement (i.e., without fines or without a significant amount of fines) can be used as the reference data. Hence, acoustic waves obtained from a normal gravel pack placement will be more attenuated than the acoustic waves obtained from a packed-off gravel pack, thus, indicating a packed-off gravel pack condition.

Figure 3:
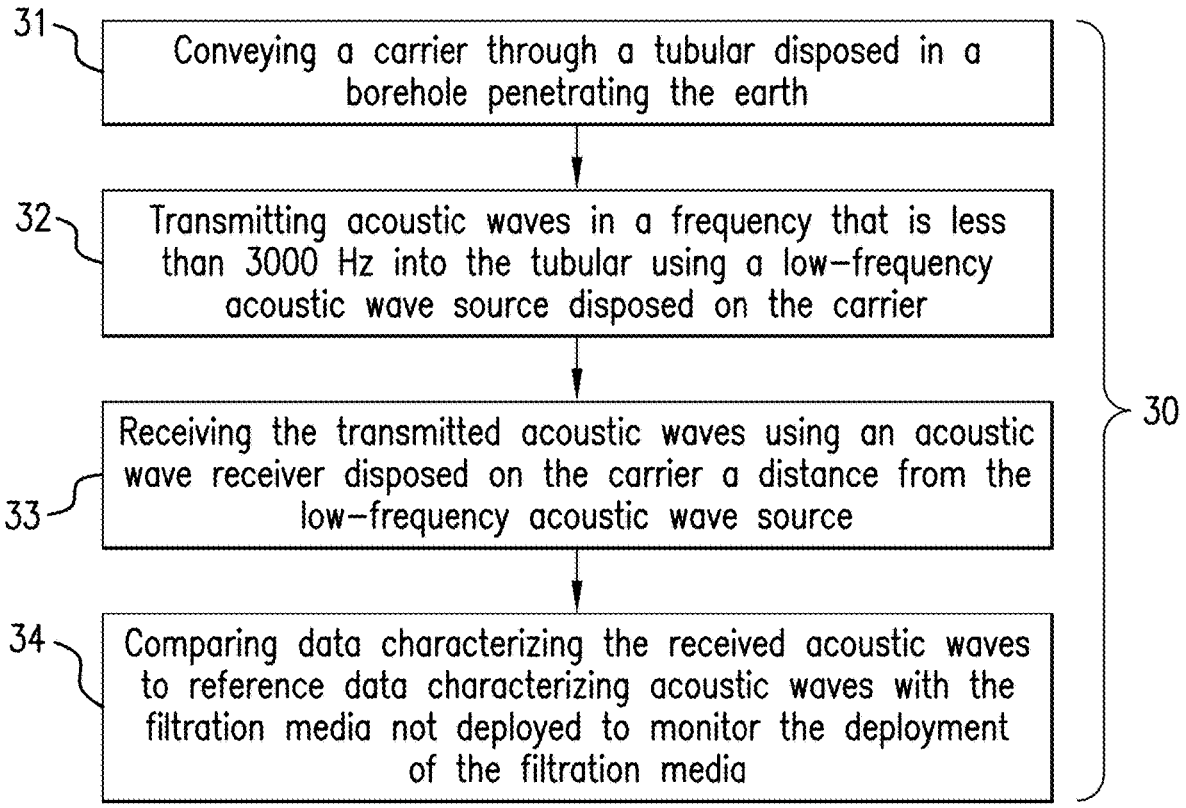
FIG. 3 is a flow chart for a method for monitoring deployment of filtration media at least partially surrounding a tubular disposed in a borehole penetrating the earth.

FIG. 3 illustrates a flow chart for a method 30 for monitoring deployment of filtration media at least partially surrounding a tubular disposed in a borehole penetrating the earth. Block 31 calls for conveying a carrier through the tubular. Block 32 calls for transmitting acoustic waves in a frequency that is less than 3000 Hz into the tubular using a low-frequency acoustic wave source disposed on the carrier. Block 33 calls for receiving the transmitted acoustic waves using an acoustic wave receiver disposed on the carrier a distance from the low-frequency acoustic wave source. Block 34 calls for comparing data characterizing the received acoustic waves to reference data characterizing acoustic waves with the filtration media not deployed to monitor the deployment of the filtration media.

Set forth below are some embodiments of the foregoing disclosure:

Embodiment 1: An apparatus for monitoring deployment of filtration media at least partially surrounding a tubular disposed in a borehole penetrating the earth, the apparatus comprising: a carrier configured to be conveyed through the tubular; a low-frequency acoustic wave source disposed on the carrier and configured to transmit acoustic waves in a frequency that is less than 3000 Hz into the tubular; an acoustic wave receiver disposed on the carrier a distance from the low-frequency acoustic wave source and configured to receive acoustic waves transmitted by the low-frequency acoustic wave source; and a controller configured to compare data characterizing the received acoustic waves to reference data characterizing acoustic waves with the filtration media not deployed.

Embodiment 2: The apparatus according to any prior embodiment wherein the filtration media comprises an expandable filtration media.

Embodiment 3: The apparatus according to any prior embodiment wherein the expandable filtration media comprises a shape memory material.

Embodiment 4: The apparatus according to any prior embodiment wherein an amplitude of one or more peaks of the received acoustic waves is less than the amplitude of one or more corresponding peaks of the reference data.

Embodiment 5: The apparatus according to any prior embodiment wherein an amplitude of a spectral frequency waveform derived from the received acoustic waves is less than the amplitude of a corresponding spectral frequency waveform in the reference data.

Embodiment 6: The apparatus according to any prior embodiment wherein the filtration media comprises gravel pack.

Embodiment 7: The apparatus according to any prior embodiment wherein an amplitude of one or more peaks of the received acoustic waves is greater than the amplitude of one or more corresponding peaks of the reference data for the gravel pack.

Embodiment 8: The apparatus according to any prior embodiment wherein an amplitude of a spectral frequency waveform derived from the received acoustic waves is greater than the amplitude of a corresponding spectral frequency waveform in the reference data for the grave pack.

Embodiment 9: A method for monitoring deployment of filtration media at least partially surrounding a tubular disposed in a borehole penetrating the earth, the method comprising: conveying a carrier through the tubular; transmitting acoustic waves in a frequency that is less than 3000 Hz into the tubular using a low-frequency acoustic wave source disposed on the carrier; receiving the transmitted acoustic waves using an acoustic wave receiver disposed on the carrier a distance from the low-frequency acoustic wave source; and comparing data characterizing the received acoustic waves to reference data characterizing acoustic waves with the filtration media not deployed to monitor the deployment of the filtration media.

Embodiment 10: The method according to any prior embodiment wherein comparing comprises determining an attenuation in amplitude data of the received acoustic waves with respect to corresponding amplitude data in the reference data, Embodiment 11: The method according to any prior embodiment wherein the filtration media comprises an expandable filtration media.

Embodiment 12: The method according to any prior embodiment wherein the attenuation being greater than or equal to a threshold value signifies successful deployment.

Embodiment 13: The method according to any prior embodiment wherein the attenuation being less than the threshold value signifies unsuccessful deployment.

Embodiment 14: The method according to any prior embodiment wherein the filtration media comprises gravel pack.

Embodiment 15: The method according to any prior embodiment wherein the attenuation in amplitude data for the reference data being greater than or equal to a threshold value signifies successful deployment for the gravel pack.

Embodiment 16: The method according to any prior embodiment wherein the attenuation in amplitude data for the reference data being less than the threshold value signifies unsuccessful deployment of the gravel pack.

Embodiment 17: The method according to any prior embodiment wherein the reference data is for the gravel pack that is satisfactorily deployed and the received acoustic waves having less attenuation in amplitude data than corresponding amplitude data in the reference data indicates that the gravel pack associated with received acoustic waves is in a packed-off condition.

In support of the teachings herein, various analysis components may be used including a digital and/or an analog system. For example, the controller 11 and/or the downhole electronics 14 may include digital and/or analog systems. The system may have components such as a processor, storage media, memory, input, output, communications link (wired, wireless, optical or other), user interfaces (e.g., a display or printer), software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer-readable medium, including memory (ROMs, RAMs, optical (CD-ROMs), or magnetic (disks, hard drives or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

The term "carrier" as used herein means any device, device component, combination of devices, media and/or member that may be used to convey, house, support or otherwise facilitate the use of another device, device component, combination of devices, media and/or member. The acoustic tool 10 is one non-limiting example of a carrier. Other exemplary non-limiting carriers include drill strings of the coiled tube type, of the jointed pipe type and any combination or portion thereof. Other carrier examples include casing pipes, wirelines, wireline sondes, slickline sondes, drop shots, bottom-hole-assemblies, drill string inserts, modules, internal housings and substrate portions thereof.

Elements of the embodiments have been introduced with either the articles "a" or "an." The articles are intended to mean that there are one or more of the elements. The terms "including" and "having" and the like are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured.

The flow diagram depicted herein is just an example. There may be many variations to this diagram or the steps (or operations) described therein without departing from the spirit of the invention. For instance, the steps may be performed in a differing order, or steps may be added, deleted or modified. All of these variations are considered a part of the claimed invention.

The disclosure illustratively disclosed herein may be practiced in the absence of any element which is not specifically disclosed herein.

While one or more embodiments have been shown and described, modifications and substitutions may be made thereto without departing from the scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. An apparatus for monitoring deployment of filtration media at least partially surrounding a tubular disposed in a borehole penetrating the earth, the apparatus comprising:

a carrier configured to be conveyed through the tubular, the filtration media at least partially surrounding the tubular being disposed between the tubular and the borehole and;

a low-frequency acoustic wave source disposed on the carrier and configured to transmit acoustic waves in a frequency that is less than 3000 Hz into the tubular;

an acoustic wave receiver disposed on the carrier a longitudinal distance from the low-frequency acoustic wave source and configured to receive acoustic waves transmitted by the low-frequency acoustic wave source; and a controller configured to compare data characterizing the received acoustic waves to reference data characterizing acoustic waves with the filtration media not deployed to monitor the deployment of the filtration media by determining at least one of (i) an attenuation in amplitude data of the received acoustic waves with respect to corresponding amplitude data in the reference data or (ii) an attenuation in amplitude data in the reference data with respect to corresponding amplitude data of the received acoustic waves.

2. The apparatus according to claim 1, wherein the filtration media comprises an expandable filtration media.

3. The apparatus according to claim 2, wherein the expandable filtration media comprises a shape memory material.

4. The apparatus according to claim 2, wherein an amplitude of one or more peaks of the received acoustic waves is less than the amplitude of one or more corresponding peaks of the reference data signifies successful deployment of the filtration media.

5. The apparatus according to claim 2, wherein an amplitude of a spectral frequency waveform derived from the received acoustic waves is less than the amplitude of a corresponding spectral frequency waveform in the reference data signifies successful deployment of the filtration media.

6. The apparatus according to claim 1, wherein the filtration media comprises gravel pack.

7. The apparatus according to claim 6, wherein an amplitude of one or more peaks of the received acoustic waves is greater than the amplitude of one or more corresponding peaks of the reference data for the gravel pack signifies successful deployment of the filtration media.

8. The apparatus according to claim 6, wherein an amplitude of a spectral frequency waveform derived from the received acoustic waves is greater than the amplitude of a corresponding spectral frequency waveform in the reference data for the gravel pack signifies successful deployment of the filtration media.

9. The apparatus according to claim 1, wherein the tubular is disposed within a casing lining the borehole.

10. A method for monitoring deployment of filtration media at least partially surrounding a tubular disposed in a borehole penetrating the earth, the method comprising:

conveying a carrier through the tubular, the filtration media at least partially surrounding the tubular being disposed between the tubular and the borehole;

transmitting acoustic waves in a frequency that is less than 3000 Hz into the tubular using a low-frequency acoustic wave source disposed on the carrier;

receiving the transmitted acoustic waves using an acoustic wave receiver disposed on the carrier a longitudinal distance from the low-frequency acoustic wave source; and comparing data characterizing the received acoustic waves to reference data characterizing acoustic waves with the filtration media not deployed to monitor the deployment of the filtration media by determining at least one of (i) an attenuation in amplitude data of the received acoustic waves with respect to corresponding amplitude data in the reference data or (ii) an attenuation in amplitude data in the reference data with respect to corresponding amplitude data of the received acoustic waves.

11. The method according to claim 10, wherein the filtration media comprises an expandable filtration media.

12. The method according to claim 11, wherein the attenuation in amplitude data of the received acoustic waves with respect to corresponding amplitude data in the reference data being greater than or equal to a threshold value signifies successful deployment.

13. The method according to claim 12, wherein the attenuation in amplitude data of the received acoustic waves with respect to corresponding amplitude data in the reference data being less than the threshold value signifies unsuccessful deployment.

14. The method according to claim 10, wherein the filtration media comprises gravel pack.

15. The method according to claim 14, wherein the attenuation in amplitude data in the reference data with respect to corresponding amplitude data of the received acoustic waves being greater than or equal to a threshold value signifies successful deployment for the gravel pack.

16. The method according to claim 15, wherein the attenuation in amplitude data for the reference data with respect to corresponding amplitude data of the received acoustic waves being less than the threshold value signifies unsuccessful deployment of the gravel pack.

17. The method according to claim 14, wherein the reference data is for the gravel pack that is satisfactorily deployed and the received acoustic waves having less attenuation in amplitude data than corresponding amplitude data in the reference data indicates that the gravel pack associated with received acoustic waves is in a packed-off condition.

18. The method according to claim 10, wherein the tubular is disposed within a casing lining the borehole.

* * * * *